United States Patent [19]

Järvi

[11] Patent Number: 5,036,781

[45] Date of Patent: Aug. 6, 1991

[54] METHOD AND THE MEANS FOR REMOVING ICE FROM A SHIP'S CHANNEL

[76] Inventor: Antti K. H. Järvi, Tontunmäentie 33 D, 02200 Espoo, Finland

[21] Appl. No.: 182,363

[22] Filed: Apr. 18, 1988

[30] Foreign Application Priority Data

Apr. 24, 1987 [FI] Finland ..... 871819

[51] Int. Cl.[5] ..... B63B 35/08

[52] U.S. Cl. ..... 114/40; 114/67 A

[58] Field of Search ..... 114/40, 41, 42, 67 R, 114/67 A; 440/66, 67

[56] References Cited

U.S. PATENT DOCUMENTS

| | | | |
|---|---|---|---|
| 1,007,583 | 10/1911 | Loetzer | 440/69 |
| 3,434,447 | 3/1969 | Christensen et al. | 440/66 |
| 3,575,526 | 4/1971 | van Gunsteren | 416/90 A |
| 3,745,964 | 7/1973 | Henrich | 440/89 |
| 3,788,267 | 1/1974 | Strong | 440/66 |
| 3,924,556 | 12/1975 | Wacker | 440/66 |
| 3,985,091 | 10/1976 | Waas | 114/40 |
| 4,102,288 | 7/1978 | Berry et al. | 114/41 |
| 4,188,906 | 2/1980 | Tachmindji et al. | 440/6 |
| 4,383,829 | 5/1983 | Allen, Jr. et al. | 440/75 |
| 4,543,900 | 10/1985 | Akev | 114/40 |

FOREIGN PATENT DOCUMENTS

| | | | |
|---|---|---|---|
| 650590 | 9/1937 | Fed. Rep. of Germany . | |
| 1095697 | 6/1961 | Fed. Rep. of Germany . | |
| 2020877 | 9/1971 | Fed. Rep. of Germany . | |
| 2416562 | 11/1974 | Fed. Rep. of Germany . | |
| 3129232A1 | 2/1983 | Fed. Rep. of Germany . | |
| 3236200A1 | 5/1988 | Fed. Rep. of Germany . | |
| 47061 | 10/1973 | Finland . | |
| 100174 | 8/1980 | Finland . | |
| 854197 | 12/1987 | Finland . | |
| 2071402 | 9/1971 | France . | |
| 133892 | 11/1978 | Japan | 440/66 |
| 57092 | 4/1984 | Japan | 440/66 |
| 129784 | 5/1974 | Norway . | |
| 1203021 | 8/1970 | U.S.S.R. . | |
| 285523 | 1/1971 | U.S.S.R. . | |
| 237604 | 12/1971 | U.S.S.R. . | |
| 328030 | 3/1972 | U.S.S.R. . | |
| 382544 | 8/1973 | U.S.S.R. . | |
| 461861 | 4/1975 | U.S.S.R. | 114/67 A |
| 901153 | 5/1982 | U.S.S.R. . | |
| 958329 | 9/1982 | U.S.S.R. . | |
| 965883 | 10/1982 | U.S.S.R. . | |
| 1127805 | 12/1983 | U.S.S.R. . | |
| 1423930 | 2/1976 | United Kingdom . | |

OTHER PUBLICATIONS

"Multi-Modul Ice Management System" by Charles M. Aker; The Society of Naval Architects & Marine Engineers, Ice Tech '84.

"Ivanov Publication", Zimnaja Explutanija Objektov Vodnogo Transporta (1978), p. 117, picture 58.

"Rodionov Publication", Sovremennye Tankery 1980, pp. 274–275, picture 157.

*Primary Examiner*—Jesus D. Sotelo

*Attorney, Agent, or Firm*—Burns, Doane, Swecker & Mathis

[57] ABSTRACT

The method and the apparatus for removing ice from a ship's channel or from around the ship, to ease its navigation. The invention is characterized in that the propeller stream is used for removing the ice by turning the propeller stream up to the surface where the ice is. The removing influence of the stream can be further strengthened by diverting it also to the sides. Turning up the stream can be done for instance by mixing air into the propeller stream. Mechanical foils (8), for instance tilted ploughing rudders (9,10), can be used for turning the stream up and to the sides. The same air blowing apparatus can be used also for other applications, as loading the payload, or for biological aeration of water.

15 Claims, 3 Drawing Sheets

METHOD AND THE MEANS FOR REMOVING ICE FROM A SHIP'S CHANNEL

Figure 1:
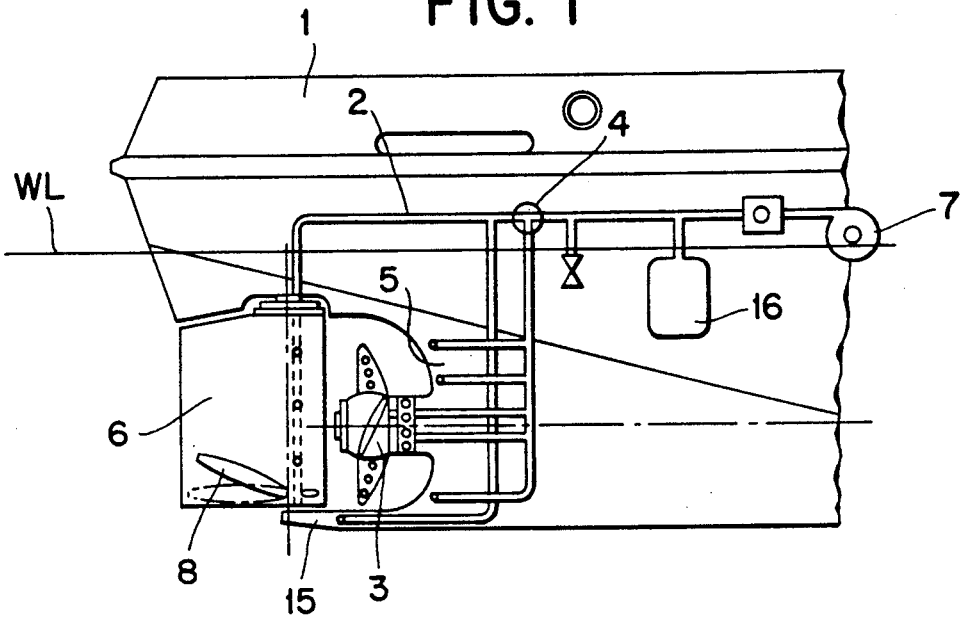

This invention concerns the method and the means for removing ice from a channel opened in the ice, or from around a ship stuck in the ice, thus releasing it.

When a ship moves in a channel opened in solid ice, it pushes part of the ice accumulated in the channel underneath the solid ice beside the channel. During the winter, relatively deep ice ridges formed of ice blocks frozen together, form beside the channel. When the ridges are so deep that the ice pieces pushed aside by the ship cannot pass under them, the ice pieces stay in the channel, filling it and making it difficult to navigate.

This invention is intended to create a method for diverting the ice pieces under the ice, far enough outside the side ridges. So that the channel can be kept navigable throughout the winter.

This invention is characterized by the use of the propeller stream for pushing the ice away. The propeller stream is turned either up to the surface or both up and to the sides. The turning up is best performed by leading air or another gas into the propeller stream. The most suitable gas is air, and it is normally led through the outlet points behind the propeller. Thus it does not reduce the propeller thrust or the motion energy of the propeller stream. In a situation where it is required to reduce resistance, air is led temporarily to the front of the propeller, according to the Finnish patent application no. 854197.

When led to the propeller stream, air is mixed with water by the eddies in the stream. The propeller stream, when it contains air, is lighter than the surrounding water. Hence it rises up to the surface where it spreads to the sides pushing the ice mass away from the channel.

In prior art, it is known to use ice ploughs positioned under the ship bottom, and ship bottom forms designed for clearing the channel, increase the resistance of the vessel also when moving in open water. They neither do have any effect on the ice beside the ship.

In prior art known devices for clearing the channel, and both the water jet and air blowing devices made for removing ice from the hull of the ship, have little power because almost all machine power is needed for the propellers when navigating through the ice. Propeller streams have been used to release a ship stuck in the ice, but their impact has not had a wide radius, because the stream spreads down and to the sides so rapidly.

This invention is characterized by the fact that the whole power of the propeller stream is used and the stream is turned up towards the surface where the ice is situated. So the force of the stream will reach a wider radius. A very small part of the total power, about 1-2%, in any case over 0.5% and below 5% of the machine's power, is enough for the blowing of air.

One possible use of this invention can be seen in the case of an icebreaker helping a slow convoy and it can use its whole engine power at full effect and continuously. If the ships in need of assistance are left behind, the icebreaker blowing air into the propeller streams will turn its rudders to plough so that its own speed will be slowed down and the channel will be cleared wider. Hence the ships in need of assistance can navigate even without towing. The icebreaker will adjust the angle of ploughing to keep the ships at the correct distance.

This invention is further characterized by the fact that the propeller streams made by the full power of the main propellers are used to transfer the ice. The energy of these propeller streams is multiple compared to the stream made only by air or other stream systems. To turn the propeller stream up, for instance by mixing it with air and so making it lighter, needs only a small part of the machine power, about 1%. A water stream containing air keeps its tendency to turn up also on the other side of the solid side ridge, so that its influence on the movement of loose ice under the solid ice is widely spread, even behind barriers.

This method is primarily suited to solid ice areas, in gulfs, in archipelago channels, and in lake and river navigation. By using this method the channel broken in solid ice is cleared of the ice blocks.

An additional advantage of this method is the fact that the quality of the water which is at its poorest during the winter under the ice, containing as it does very little oxygen, can be improved by aerating. Because oxygen is diluted more easily into ice cold water than warm water, and because the ice cover prevents air from escaping, the aerating can succeed in winter. Moreover, the air trapped under the ice will act as insulation and will therefore slow down the thickening of the ice. Also the bubbles frozen into the ice will make it weaker.

Tests have shown that blowing air into the ship's propeller stream when reversing will remove ice from around the ship and will make it easier to loosen the ship if it has been stuck in the ice, or has frozen solid during anchoring or whilst being fastened to a pier. A ship in a difficult situation, which has to move alternately by backing to make speed, and by ramming, will open an open water area around it for making speed by directing air continuously into the propeller stream. When reversing the air is blown through the outlets in the front of the propeller.

Figure 2:
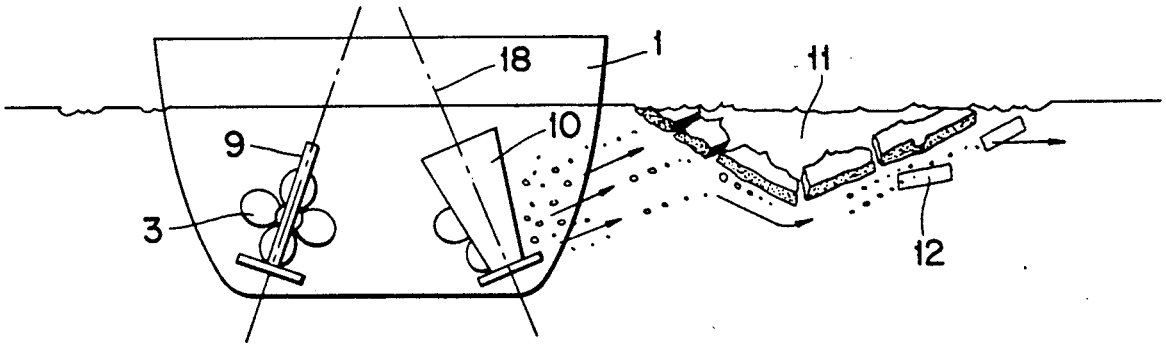
Figure 3:
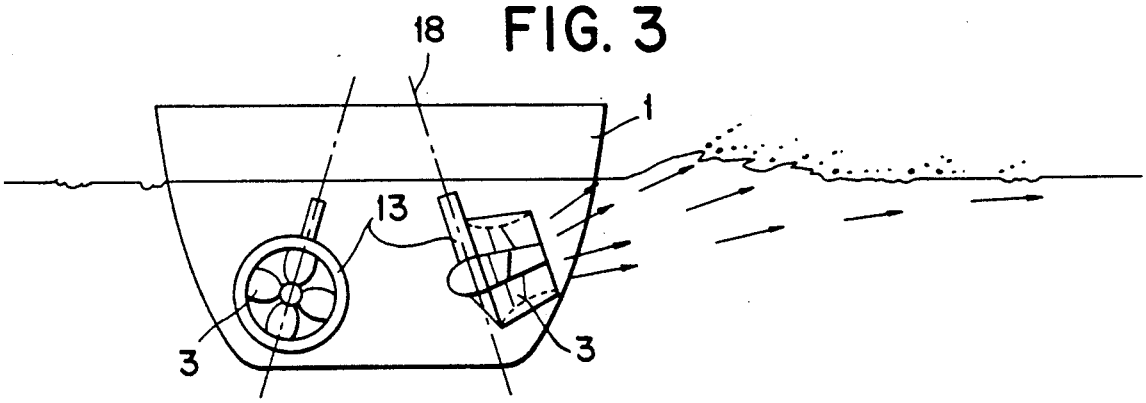
Figure 4A:
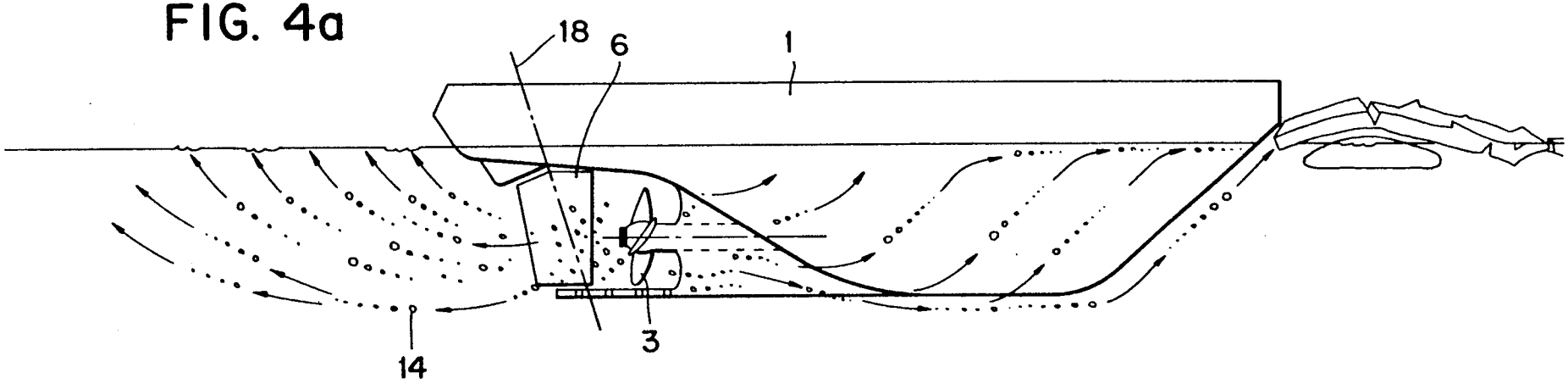
Figure 4B:
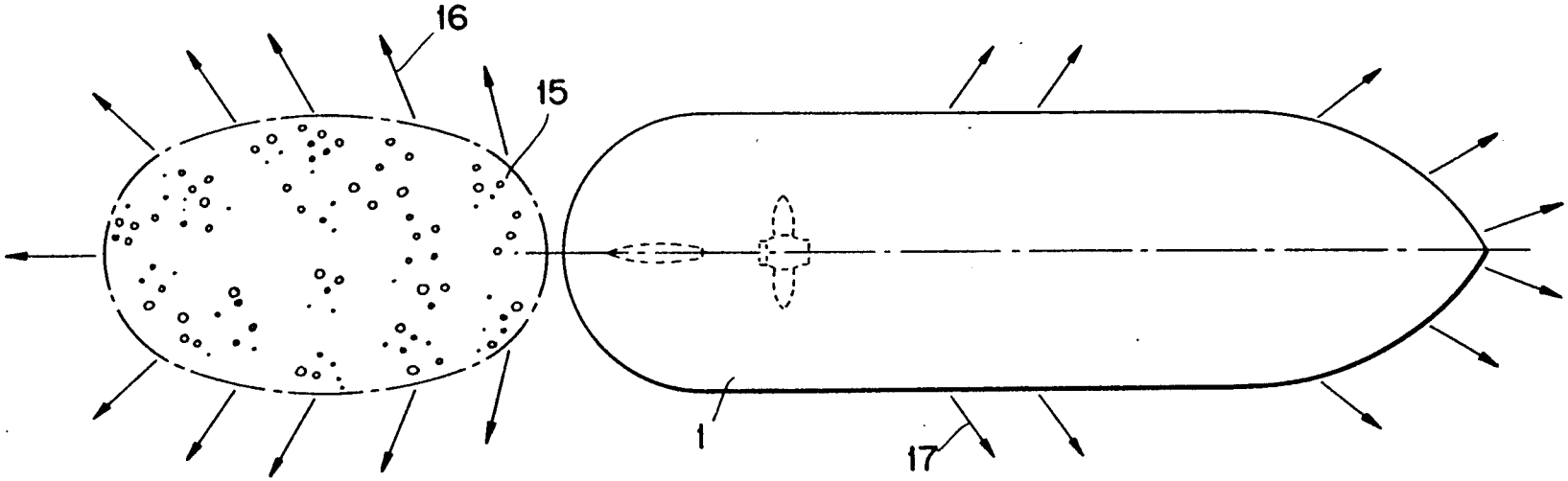
Figure 5:
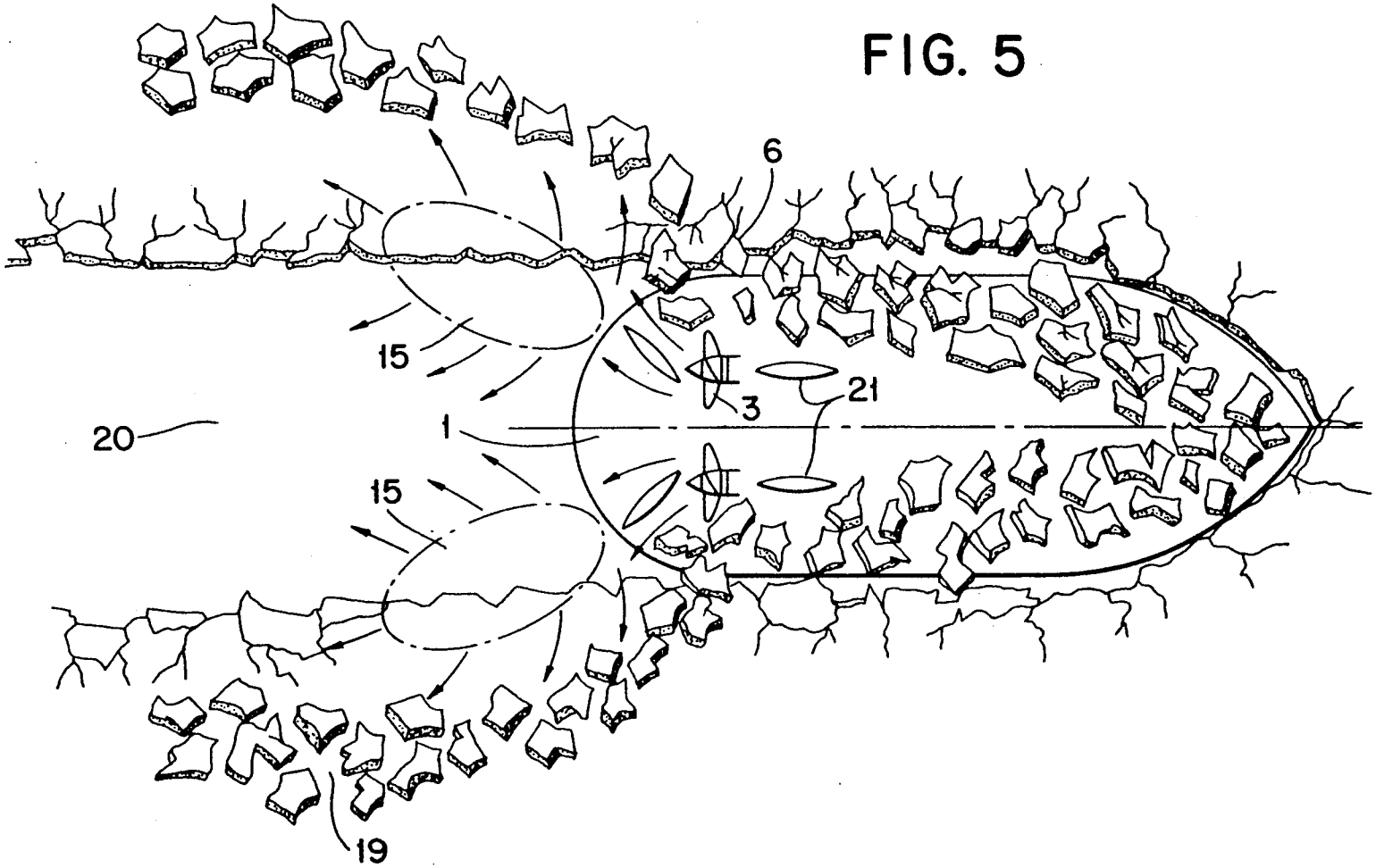
Figure 5:
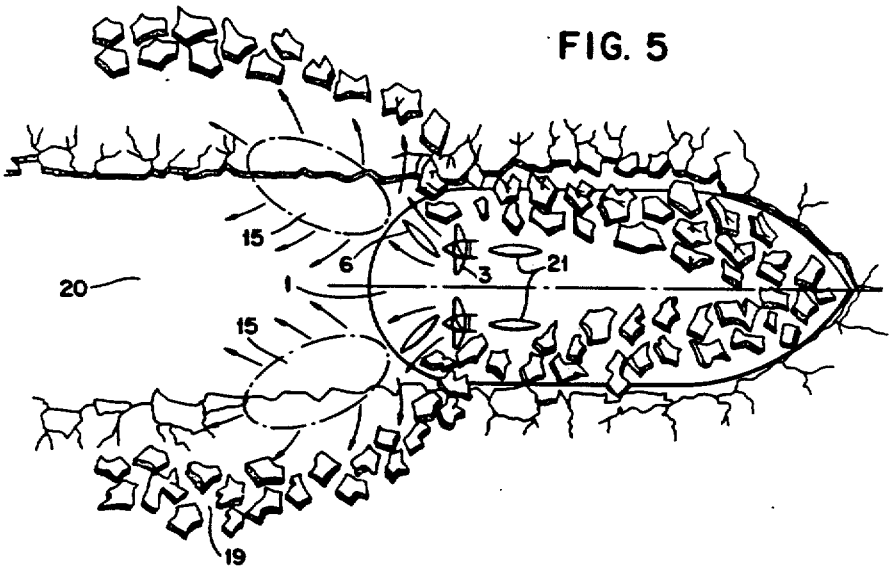

The invention and its details will be explained more closely as follows with references to the accompanying drawings, wherein FIG. 1 is a side view of a ship stern where the invention is applied, FIG. 2 is a rear view of a two propeller stern with inclined rudders, of which the one on the right is turned, FIG. 3 is a rear view of a ship stern with two rudder propellers with nozzles, of which the one on the right is turned, FIG. 4*a* shows a side view of an icegoing ship and propeller streams turned up by air blowing, FIG. 4*b* shows a top view of an icegoing ship and propeller streams turned up by air blowing, FIG. 5 is a bottom view of a two propeller icebreaking ship with propeller streams mixed with air and the rudders turned to a ploughing position.

In the embodiment of FIG. 1 there is in the rear part of the ship (1) a pipe system (2) in order to pass air to the front and to the rear of the propeller (3). The pipe system is provided with a valve (4) in order to lead air either to the rear or to the front of the propeller. The pipes leading air behind the propeller are opened at the front edge of the rudder (6) and to the top surface of the sole piece (15). When reversing, pipes leading air to the front of the propeller are opened at the rear face of the sternpost (5) and at the propeller. For the supply of the air into the pipe system, the pipe system is provided with a fan (7) or with a compressor. The system may also be provided with a compressed air tank (16). The propeller is located completely below the water level WL. When the ship runs forwards and the resistance to rotation of the propeller must be lowered because of ice, air is passed to the front of the propeller, its suction side. At the lower edge of the rudder (6) there is a foil (8) to lift the propeller stream up. In this picture the rear part of the foil is turnable and the front part is fixed. Air is also led to the lower part of the propeller stream through this foil.

FIG. 2 shows a solution where the rudders (9, 10) are in an inclined position, so that the rudders when turned outwards, as in FIG. 2 the right one (10) is, lift the rudder stream to the surface. At the lower edges of the rudders there are fixed foils (8) preventing stream from spreading downwards. The propeller stream without air, when hitting a solid ice ridge, is turned downwards, but the lightening influence of air will lift the stream behind the ridge up again to the lower surface of the solid ice to move loose pieces of ice (12) further away.

FIG. 3 shows a solution with rudder propellers (13) with nozzles which are also inclined so that the propeller stream when turned outwards will rise to the surface.

FIG. 4 illustrates how the propeller stream, lifted up by air bubbles (14) when running forward, is diverted to the surface at the elliptical area (15) behind the ship. Arrows (16) show the flow at the surface away from the channel. FIG. 4 also shows how the propeller stream of a reversing propeller is lifted by the air to the surface around the ship, and is turning at the surface according to the arrows (17) away from the ship. The rudder post (18) of the rudder (6) is inclined so that the upper end is further behind. When the rudder is turned to the side it will lift the propeller stream pushing it up towards the surface.

FIG. 5 shows an icebreaker with two propellers, from below, breaking the ice and clearing the channel. The rudders (6) have been turned to plough. The propeller streams are lifted either by inclined rudders or by air mixed in the propeller stream, to the under surface of the solid ice in the areas (15). The loose pieces of ice (12) from the sides of the ship are transferred by the propeller streams to an area (19) at a distance from the channel (20). The figure also shows the rudders (21) in front of the propellers (3). When reversing these can turn the propeller streams to the sides, where air will lift the propeller streams up to the surface, or if these rudders are inclined as in FIGS. 2 and 3, they can turn the streams up to the surface.

The invention is not confined to the above embodiments, it may also perform a variety of tasks within the scope of the patent's claims. It is possible for instance to increase the ploughing of the propeller streams with unsymmetrical rudder forms and hull forms specially designed for this application etc.

In this text the term "main propellers" means all propellers used to transmit the main propulsion power to propulsion when the ship travels at a straight course.

What is claimed is:

1. A method of removing ice from a ship's channel by an icegoing ship having at least one main propeller and being positioned between sides of the channel, comprising adjustably turning said at least one main propeller positioned between sides of the ship for turning a stream created by the propeller upward in the direction of ice pieces so as to push the ice pieces away from said ship's channel and under the ice adjacent said ship's channel, said at least one main propeller transmitting main propulsion power to propel the ship raising the propeller stream upward by mixing material that is lighter than water into the propeller stream, selecting the material from a group including gas, a water and gas mixture and exhaust gas, and directing the mixture to the propeller stream through openings located vertically below the propeller.

2. A method as claimed in claim 1, wherein the propeller stream is turned adjustable upwardly and outwardly to sides of the ship.

3. A method as claimed in claim 1, characterized by the lighter than water material being directed into the propeller stream through openings located behind the propeller when the propeller is pushing forward and through openings located in front of the propellers, when the propeller is reversing.

4. A device for removing ice from a ship's channel, comprising means for directing propeller streams adjustably upwardly toward the ice, said propeller streams being produced by main propellers of an icegoing ship and including gas blowing equipment and gas outlet openings located on a trailing side of the propellers.

5. Device as claimed in claim 4, further including means for adjustably directing the propeller streams to sides of the ship, the propeller being positioned between sides of the channel.

6. Device as claimed in claim 4, wherein said gas outlet openings provide a gas to the propeller stream.

7. Device as claimed in claim 6, wherein said gas outlet openings are located behind and in front of the propellers and a valve system is provided for directing the gas to lift the propeller stream according to the thrust direction of the propellers to the pressure side of the propellers and to decrease engine overload and cavitation to the suction side of the propellers.

8. Device as claimed in claim 4, wherein said means for directing propeller streams are mechanical means.

9. Device as claimed in claim 4, wherein the propeller streams are directed upwardly and are prevented from spreading downwardly by a foil arrangement.

10. Device as claimed in claim 4, wherein rudders are provided in front of the propellers to simultaneously turn the propeller streams, when reversing, to both sides of the ship and up to the ice so as to move the ice without turning the ship.

11. A device for removing ice from a ship's channel, comprising means for directing propeller streams adjustably upwardly toward the ice, said propeller streams produced by main propellers of an icegoing ship, said propeller streams being directed upwardly and prevented from spreading downwardly by a foil arrangement.

12. Device as claimed in claim 11, wherein said means for directing propeller streams are steering means inclined, so that when turned the propeller stream is directed upwardly.

13. Device as claimed in claim 12, wherein the inclination is greater than 10°.

14. Device as claimed in claim 13, wherein the inclination is greater than 15°.

15. Device as claimed in claim 14, wherein the ship is equipped with means which will lessen ploughing of the steering means so that capability of the ship to steer is not weakened during hard turns of the ship.

* * * * *

UNITED STATES PATENT AND TRADEMARK OFFICE

CERTIFICATE OF CORRECTION

PATENT NO. : 5,036,781

DATED : August 6, 1991

INVENTOR(S) : Antti K. H. Jarvi

It is certified that error appears in the above-indentified patent and that said Letters Patent is hereby corrected as shown below:

The drawing sheet, consisting of Fig. 5, should be deleted to be replaced with the drawing sheet, consisting of Fig. 5, as shown on the attached page.

Signed and Sealed this

Twelfth Day of October, 1993

*Attest:*

*Attesting Officer*

BRUCE LEHMAN

*Commissioner of Patents and Trademarks*